US006062457A

United States Patent [19]

Huang

[11] Patent Number: 6,062,457

[45] Date of Patent: May 16, 2000

[54] STAPLER

[76] Inventor: Bao-Ruh Huang, No. 9, Lane 79, Guang Ming Road, Hua Tan Hsiang, Chang Hua Hsien, Taiwan

[21] Appl. No.: 09/478,506

[22] Filed: Jan. 6, 2000

[51] Int. Cl.[7] ..... B25C 5/11

[52] U.S. Cl. ..... 227/134

[58] Field of Search ..... 227/134, 120

[56] References Cited

U.S. PATENT DOCUMENTS

| | | | |
|---|---|---|---|
| 2,097,865 | 11/1937 | Stockel | 227/134 |
| 2,147,380 | 2/1939 | Peterson | 227/134 |
| 2,723,392 | 11/1955 | Cole | 227/134 |
| 2,922,163 | 1/1960 | Smick | 227/134 |
| 3,099,011 | 7/1963 | Wandel | 227/134 |
| 5,421,502 | 6/1995 | Huang | 227/134 |

*Primary Examiner*—Scott A. Smith
*Attorney, Agent, or Firm*—Bacon & Thomas, PLLC

[57] ABSTRACT

A stapler includes a base with a magazine and an arm respectively connected to the base. A positioning plate is received in the magazine and a first spring connected between the positioning plate and the magazine. A pusher is slidably engaged with the positioning plate and a connection plate is connected to the pusher. The connection plate is slidably connected between the arm and the magazine. A protrusion extends from the magazine and a positioning hook extends from the positioning plate so that a second spring has one end connected to the pusher and the second spring goes around the protrusion on the magazine, and the other end of the second spring is engaged with the positioning hook. The second spring will not be exposed when loading staples and the second spring does not occupy the space of the magazine.

6 Claims, 6 Drawing Sheets

STAPLER

FIELD OF THE INVENTION

The present invention relates to a stapler having a magazine with a retaining plate pivotally received therein. A first spring is connected between the magazine and the retaining plate and a second spring connected between the retaining plate and a pusher so as to obtain an efficient space of the magazine and the second spring will not be exposed when reloading staples.

BACKGROUND OF THE INVENTION

A first conventional stapler 60 known to applicant is shown in FIGS. 4 and 5 and generally includes a base 600 with an arm 601 pivotally connected to an end of the base 600. A magazine 65 is located between the arm 601 and the base 600, and a pusher 64 is movably received in the magazine 65. A spring 61 is connected between the pusher 64 and an ejection plate 62 in the arm 601 so that when the arm 601 is located in a position as shown in FIG. 5, the pusher 64 urges the staples in the interior 66 of the magazine 65. When pushing the arm 601 toward the base 600, one of the staples is pushed out from the magazine 65 by the injection plate 62. As shown in FIG. 4, when reloading the staples, the arm 601 is pivoted away from the magazine 65 so as to retract the pusher 64 to let the staples be loaded in the magazine 65. Nevertheless, the spring 61 will be exposed and could hurt the user. Even worse, the spring 61 could be over extended and looses its nature, the staples are then not well positioned by the pusher 64. A second conventional stapler 60 known to applicant is shown in FIGS. 6 and 7 and generally includes a base 600 with an arm 601 pivotally connected to an end of the base 600. A magazine 65 is located between the arm 601 and the base 600, and a pusher 64 is movably received in the magazine 65. A connection plate 69 having one end connected to the pusher 64 and the other end of the pusher 64 is slidably engaged with an inside 62 of the arm 601. A rod 68 is connected in the magazine 65 and a spring 61 is mounted to the rod 68. The spring 61 is biased between the pusher 64 and an end of the arm 601. This type of stapler improves the shortcoming of exposing of the spring as shown in FIG. 4. However, the spring 61 occupies a space in the magazine 65 so that only a short loading space can be used. Therefore, the size of the stapler has to be increased or the numbers of staples to be loaded are reduced.

The present invention intends to provide a stapler wherein the spring will not be exposed when the arm is pivoted away from the base, and the space in the magazine is not changed.

SUMMARY OF THE INVENTION

In accordance with one aspect of the present invention, there is provided a stapler and comprising a base and an arm pivotally connected to a first end of the base. An anvil is located on a top of a second end of the base and an ejection plate is connected to the arm. A magazine has a first end thereof pivotally connected to the first end of the base and a slit is defined in a second end of the magazine. A protrusion extends from the second end of the magazine and a first hook extends from the first end of the magazine. A positioning plate is received in the magazine and a first hole is defined in a first end of the positioning plate for the first hook extending through the first hole. A second hole is defined through a second end of the positioning plate for the protrusion extending through the second hole. A first positioning hook extends from the positioning plate. An engaging end is defined in the first end of the positioning plate so that a first spring is connected between the engaging end and the first hook.

A connection plate is slidably connected between the arm and the magazine. A pusher is engaged with one end of the connection plate and slidably mounted to the positioning plate. A second positioning hook extends from the pusher. A second spring has one end thereof connected to the first engaging hook and the other end of the second spring is engaged with the second engaging hook of the pusher. The second spring goes around the protrusion.

The object of the present invention is to provide a stapler wherein a second spring connected to a pusher is not exposed when loading staples.

Another object of the present invention is to provide a stapler wherein a second spring connected to a pusher is not received in the magazine.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
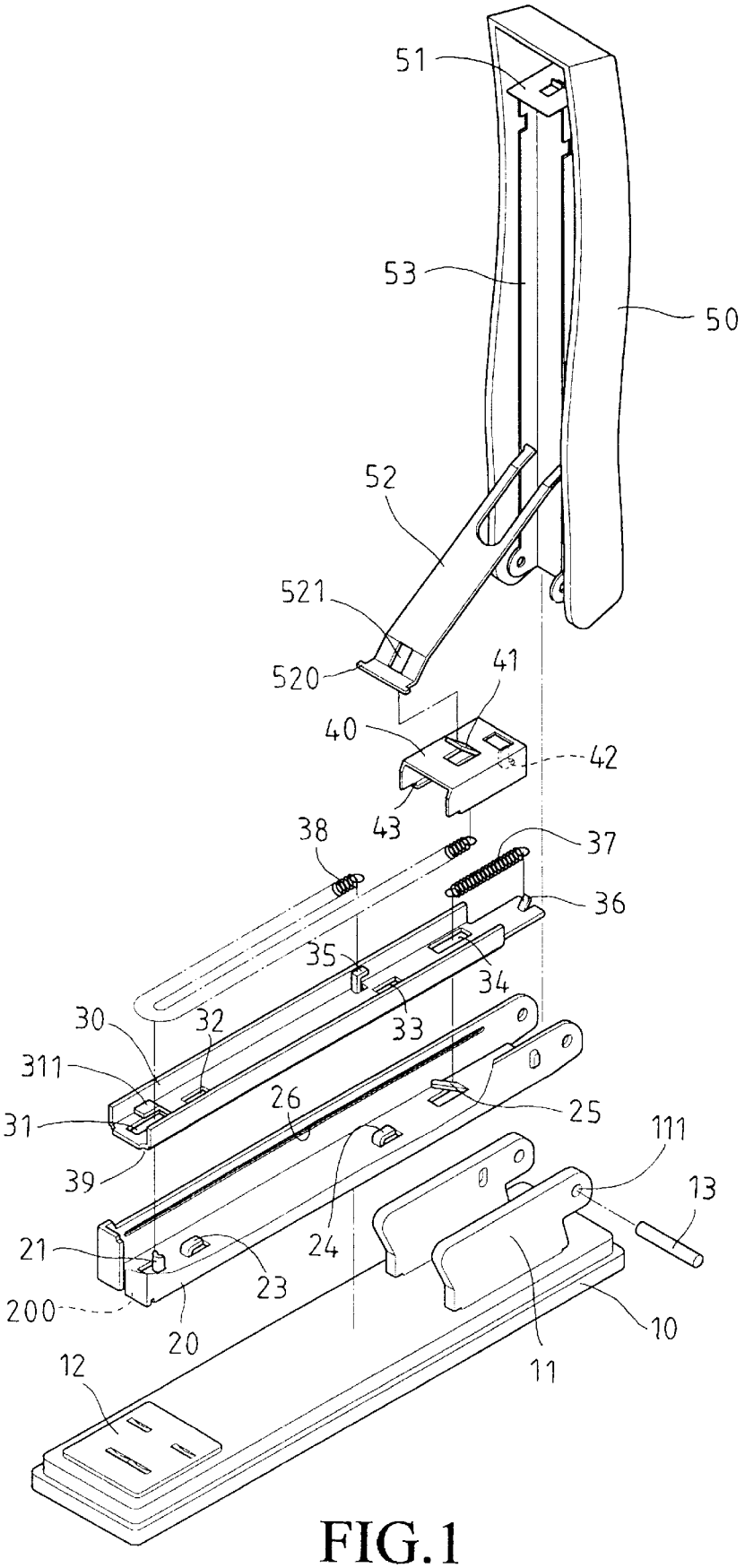
FIG. 1 is an exploded view to show a stapler in accordance with the present invention.
Figure 2:
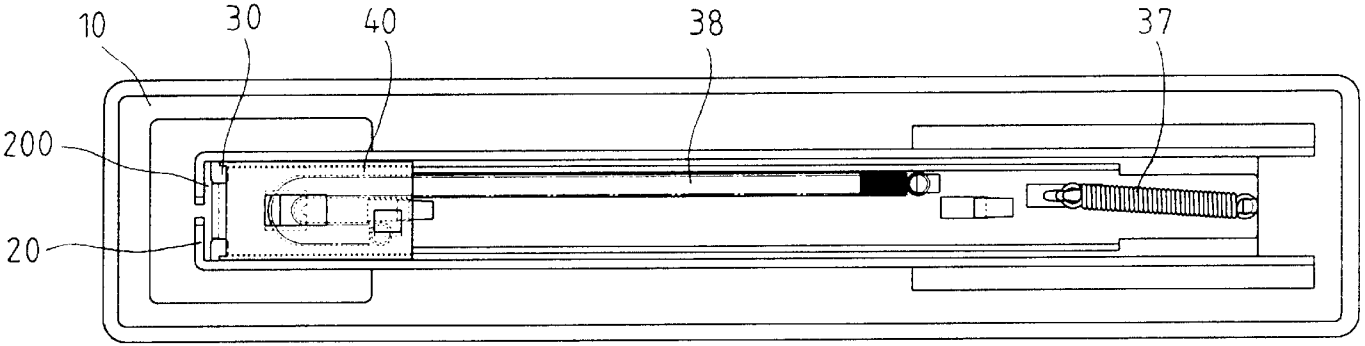
FIG. 2 is a top view to show when the pusher is positioned at the second end of the magazine while the arm is not pivoted away from the base.
Figure 3:
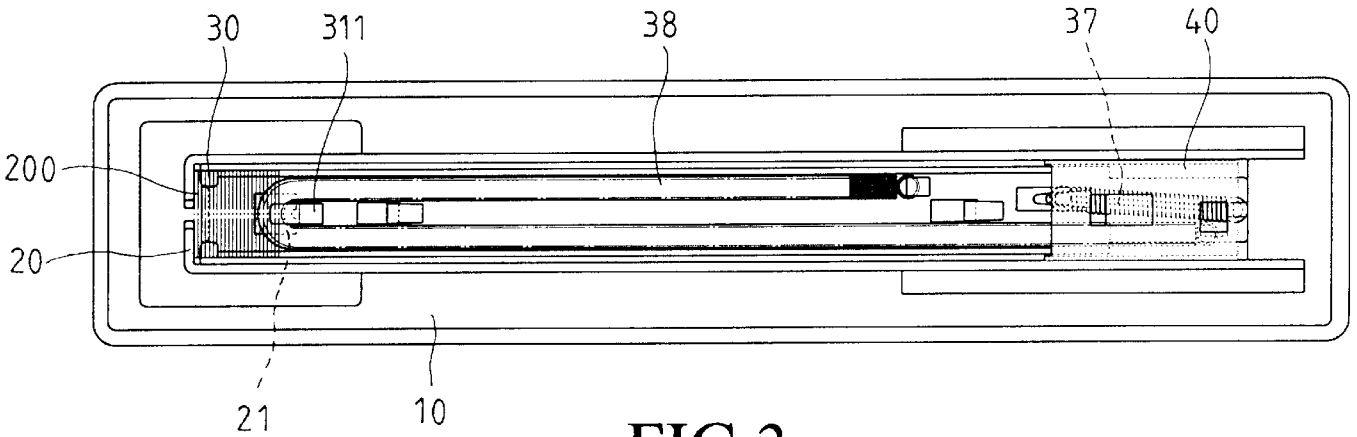
FIG. 3 is a top view to show that the pusher is pulled when the arm is pivoted away from the base.
Figure 4:
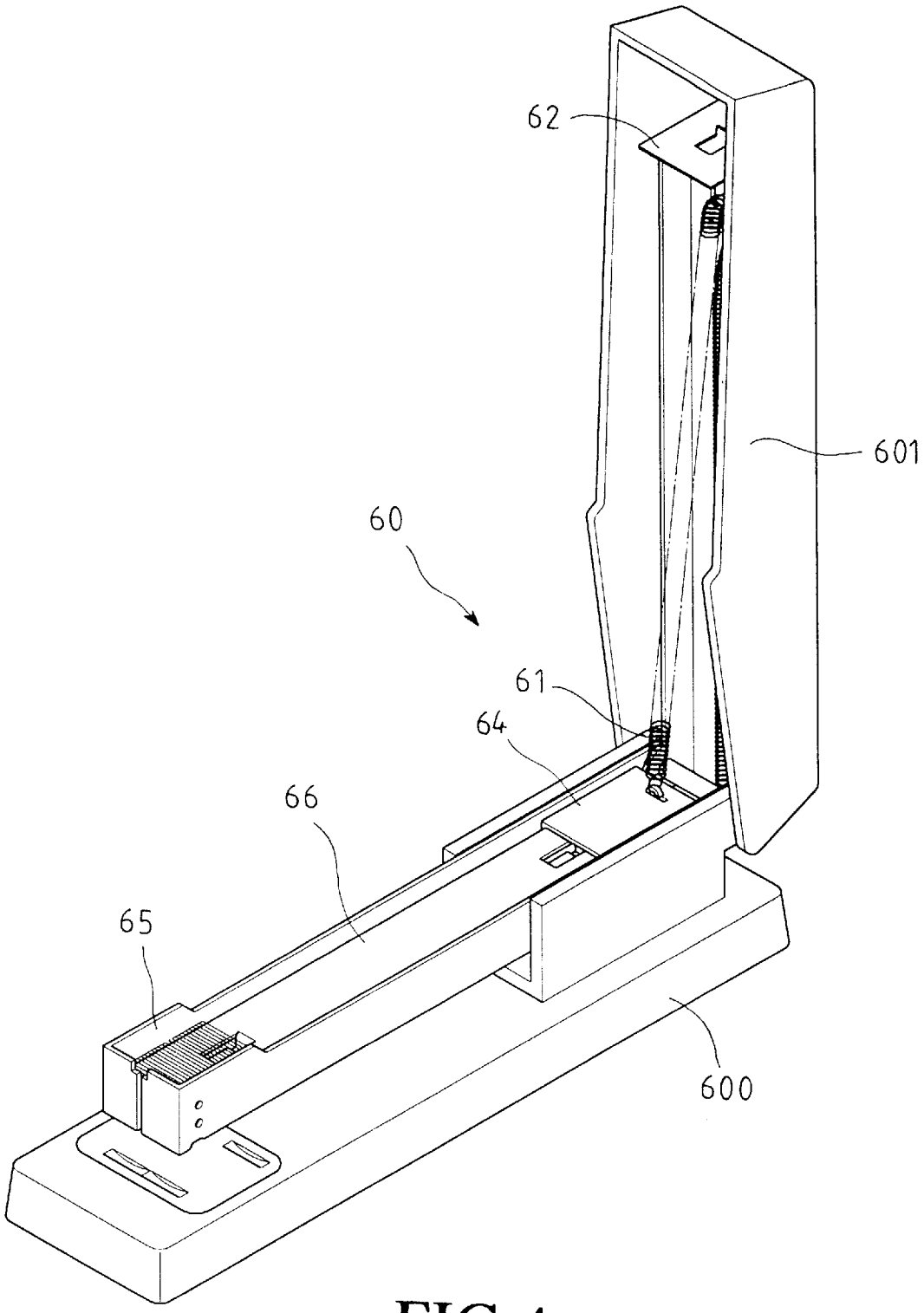
FIG.4 PRIOR ART
FIG. 4 is a perspective view to show a first embodiment of a conventional stapler.
Figure 5:
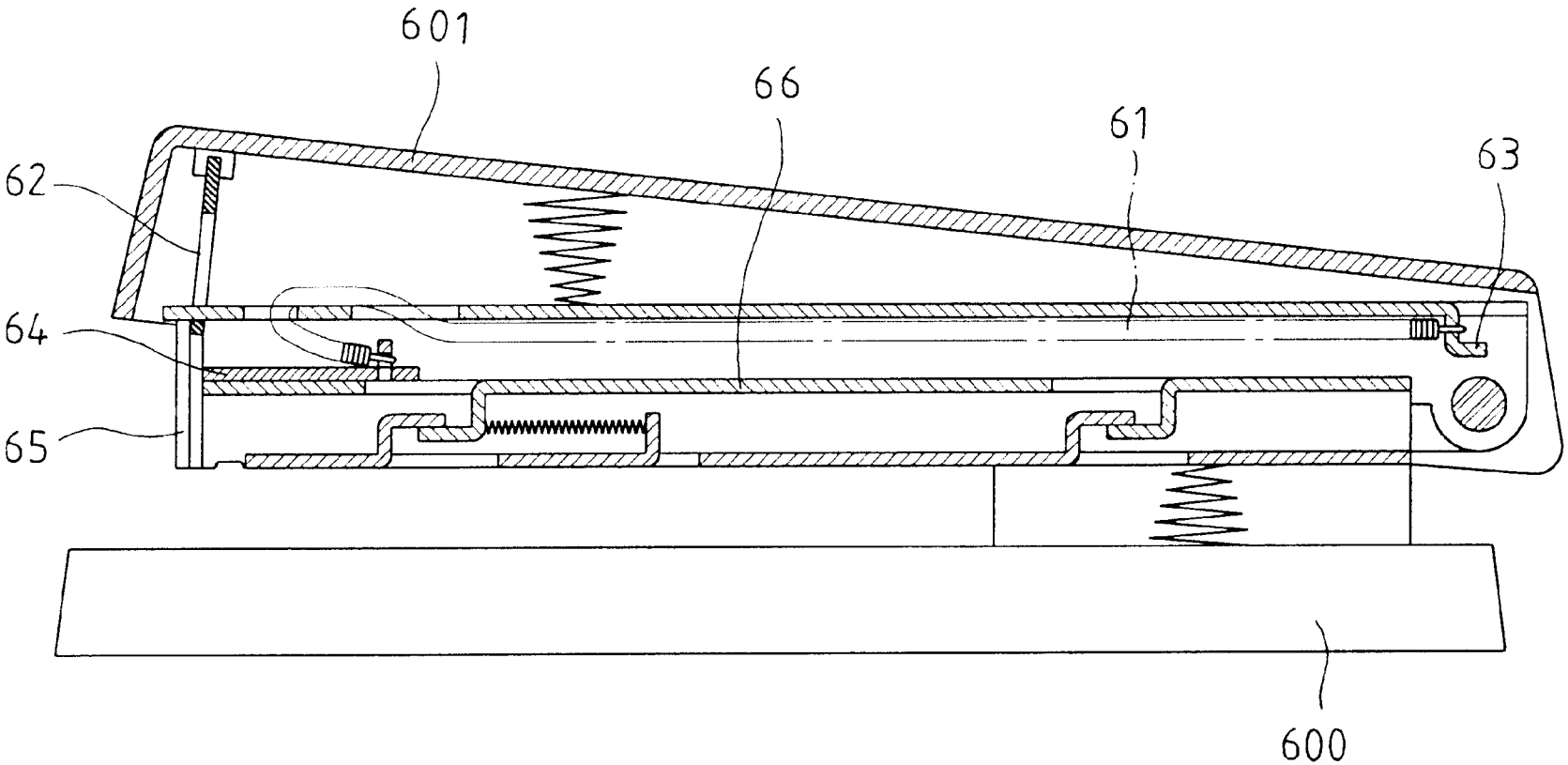
FIG.5 PRIOR ART
FIG. 5 is a side elevational view to show the first embodiment of the conventional stapler.
Figure 6:
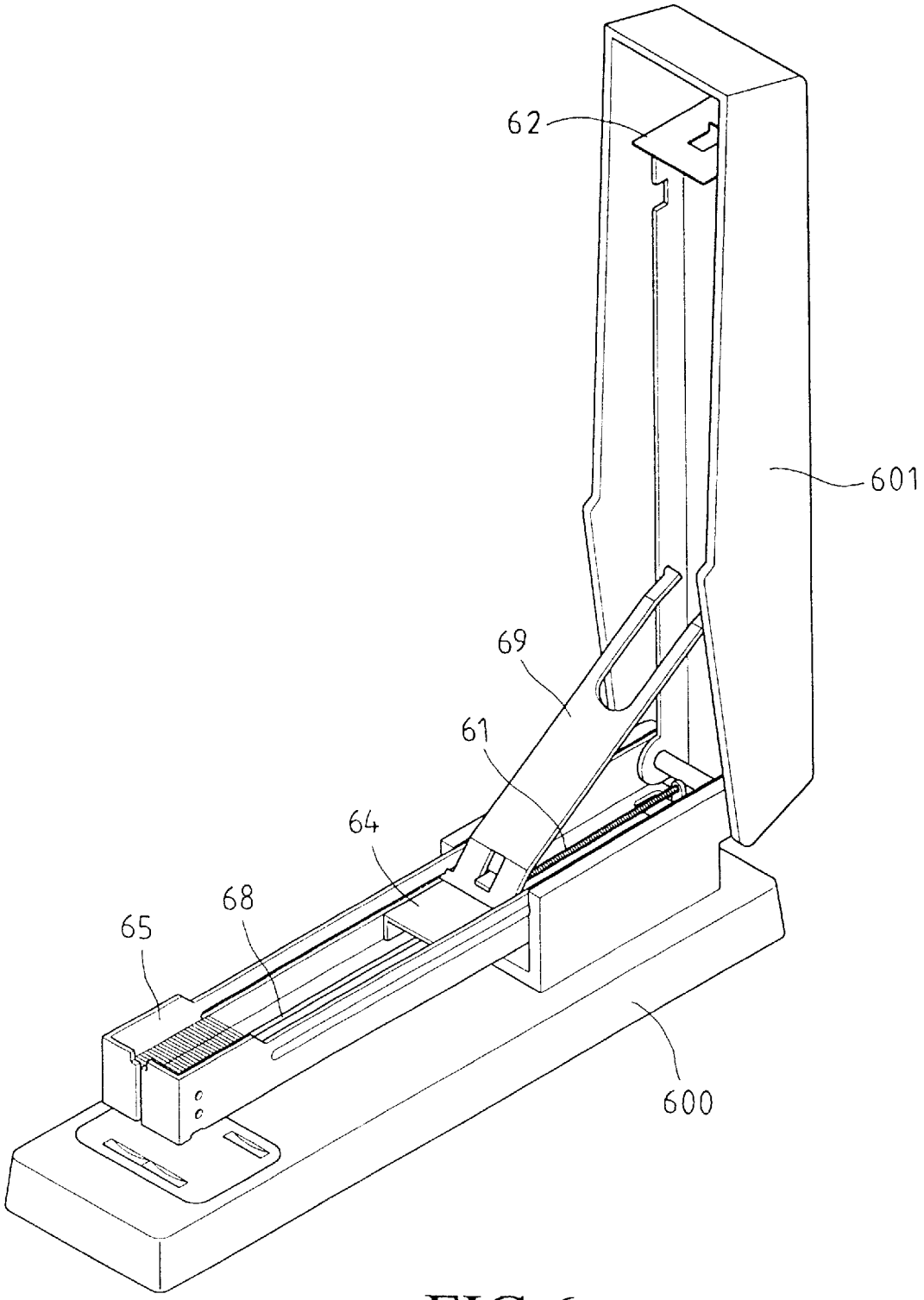
FIG.6 PRIOR ART
FIG. 6 is a perspective view to show a second embodiment of a conventional stapler.
Figure 7:
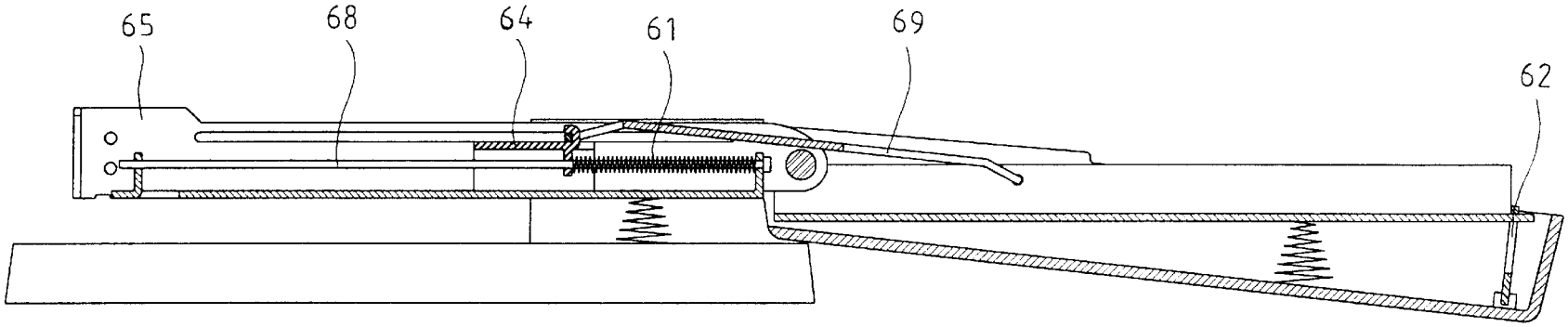
FIG.7 PRIOR ART
FIG. 7 is a side elevational view to show the second embodiment of the conventional stapler when the arm of the stapler is pivoted away from the base.

Referring to FIGS. 1 to 3, the stapler in accordance with the present invention comprises a base 10 which has two lugs 11 on a first end thereof and an anvil 12 is located on a top of a second end of the base 10. An arm 50 is pivotally connected to the two lugs 11 by extending a pin 13 through holes 111 in the two lugs 11 and an end of the arm 50. An ejection plate 51 is connected to the other end of the arm 50. An inside plate 53 is connected to an inside of the arm 50 and a connection plate 52 has one end thereof slidably connected to the inside plate 53. Two side protrusions 520 extend laterally from two sides of the other end of the connection plate 52 and an aperture 521 is defined through the connection plate 52.

A magazine 20 has a first end thereof pivotally connected to the two lugs 11 on the first end of the base 10 and a slit 200 is defined in a second end of the magazine 20. The magazine 20 has two sidewalls and each sidewall has a groove 26 defined in an inside thereof so that the side protrusions 520 of the connection plate 52 are slidably engaged with the two grooves 26. A protrusion 21 extends from the second end of the magazine 20 and a first hook 25 extends from the first end of the magazine 20. Two connection hooks 23, 24 respectively extend from the magazine 20.

A positioning plate 30 is received in the magazine 20. A first hole 34 is defined in a first end of the positioning plate 30 so that the first hook 25 extends through the first hole 34, and a second hole 31 is defined through a second end of the positioning plate 30 so that the protrusion 21 extends through the second hole 31. The positioning plate 30 has two slots 32, 33 defined therethrough so that when the positioning plate 30 is received in the magazine 20, the two connection hooks 23, 24 are engaged with the two slots 32, 33. A first positioning hook 35 extends from the positioning plate 30 and is located between the first hole 34 and the second hole 31. An engaging end 36 is defined in the first end of the positioning plate 30 so that a first spring 37 is connected between the engaging end 36 and the first hook 25 to press the positioning plate 30 toward the magazine 20.

A pusher 40 is an inverted U-shaped member and has two flanges 43 extending inward from two sides of the pusher 40. Two longitudinal engaging recesses 39 are defined in two sides of a bottom of the positioning plate 30 so that the two flanges 43 of the pusher 40 are slidably engaged with the two longitudinal engaging recesses 39. A second positioning hook 42 extends from an end of the pusher 40 and a third hook 41 extends from a top of the pusher 40. The third hook 41 is engaged with the aperture 521 of the connection plate 52.

A second spring 38 has one end thereof connected to the first engaging hook 35 and the other end of the second spring 38 goes around the protrusion 21 and is engaged with the second engaging hook 42 of the pusher 40. It is to be noted that a retaining member 311 extends from the positioning plate 30 and a distal end of the retaining member 31 is located above the protrusion 21.

Accordingly, when pivoting the arm 50 away from the base 10, the positioning plate 30 and the pusher 40 are removed from the magazine 20, and the second spring 38 is moved with the positioning plate 30 so that the second spring 38 is covered by the positioning plate 30 and is not exposed to the user. The interior of the magazine 20 is not occupied by the second spring 38. When re-positioning the arm 50 toward the base 10, the pusher 40 is pulled by the second spring 38 and urges the staples in the magazine 20.

While we have shown and described various embodiments in accordance with the present invention, it should be clear to those skilled in the art that further embodiments may be made without departing from the scope and spirit of the present invention.

What is claimed is:

1. A stapler comprising:

a base and an arm pivotally connected to a first end of said base, an anvil located on a top of a second end of said base and an ejection plate connected to said arm;

a magazine having a first end thereof pivotally connected to said first end of said base and a slit defined in a second end of said magazine, a protrusion extending from said second end of said magazine and a first hook extending from said first end of said magazine;

a positioning plate received in said magazine, a first hole defined in a first end of said positioning plate so that said first hook extends through said first hole, a second hole defined through a second end of said positioning plate so that said protrusion extending through said second hole, a first positioning hook extending from said positioning plate and located between said first hole and said second hole, an engaging end defined in said first end of said positioning plate, a first spring connected between said engaging end and said first hook;

a connection plate slidably connected between said arm and said magazine, a pusher engaged with one end of said connection plate and slidably mounted to said positioning plate, a second positioning hook extending from said pusher, and a second spring having one end thereof connected to said first engaging hook and the other end of said second spring engaged with said second engaging hook of said pusher, said second spring going around said protrusion.

2. The stapler as claimed in claim 1 further comprising a retaining member extending from said positioning plate and a distal end of said retaining member located above said protrusion.

3. The stapler as claimed in claim 1, wherein said magazine has two sidewalls and each sidewall has a groove defined in an inside thereof, said connection plate having two side protrusions which are slidably engaged with said two grooves in said two sidewalls of said magazine.

4. The stapler as claimed in claim 1, wherein said magazine has two connection hooks extending therefrom and said positioning plate has two slots defined therethrough so that said two connection hooks are engaged with said two slots.

5. The stapler as claimed in claim 1, wherein said pusher is an inverted U-shaped member and has two flanges extending inward from two sides of said pusher, two longitudinal engaging recesses defined in two sides of a bottom of said positioning plate so that said two flanges of said pusher are slidably engaged with said two longitudinal engaging recesses.

6. The stapler as claimed in claim 1, wherein said pusher has a third hook extending therefrom and said connection plate has an aperture defined in one of two ends thereof, said third hook engaged with said aperture.

* * * * *